US005099086A

United States Patent [19]

Roy

[11] Patent Number: 5,099,086

[45] Date of Patent: Mar. 24, 1992

[54] EXTRACTION OF COMMERCIALLY VALUABLE CHEMICALS FROM TIRE-DERIVED PYROLYTIC OILS

[75] Inventor: Christian Roy, Sillery, Canada

[73] Assignee: Universite Laval, Quebec, Canada

[21] Appl. No.: 372,568

[22] Filed: Jun. 28, 1989

[51] Int. Cl.[5] ..... C07C 1/00

[52] U.S. Cl. ..... 585/1; 585/241

[58] Field of Search ..... 585/1, 241

[56] References Cited

U.S. PATENT DOCUMENTS 4,175,211 11/1979 Chen et al. ..... 585/241
4,250,158 2/1981 Solbakken et al. ..... 585/241
4,384,150 5/1983 Lyakhevich et al. ..... 585/241
4,642,401 2/1987 Coenen et al. ..... 585/241
4,647,443 3/1987 Apffel ..... 585/241
4,740,270 4/1988 Roy ..... 201/35

*Primary Examiner*—Asok Pal
*Attorney, Agent, or Firm*—Foley & Lardner

[57] ABSTRACT

Commerically valuable chemicals are extracted from tire-derived pyrolytic oils by subjecting the pyrolytic oils to a fractional distillation at a temperature of up to about 204° C. under atmospheric pressure to isolate at least one commercially valuable chemical selected from the group consisting of paraffins, naphthenes, olefins and aromatics. Particularly valuable chemicals which can be extracted from tire-derived pyrolytic oils are benzene, toluene, xylene, styrene and limonene-dl.

6 Claims, No Drawings

EXTRACTION OF COMMERCIALLY VALUABLE CHEMICALS FROM TIRE-DERIVED PYROLYTIC OILS

The present invention relates to improvements in the field of tire recycling. More particularly, the invention is directed to the extraction of commercially valuable chemicals from tire-derived pyrolytic oils.

Tire recycling has become a necessity because of the accumulation of large quantities of scrap tires which represents a major environmental problem. Each year, about 24 million used rubber tires are disposed of in Canada and about 250 million in the United States. While some of these tires are recapped or ground up for special uses, most are simply dumped in rural farm land or in landfill sights. When buried in landfills they eventually float to the surface, and when piled the nonbiodegradable rubber will cause serious damage if ignited by lightning or vandals.

On the other hand, used rubber tires represent a source of energy and raw products for the production of rubber parts. By thermal decomposition of rubber, it is possible to recover to a certain extent the initial ingredients which constitute a tire. To this end, Applicant has already proposed in U.S. Pat. No. 4,740,270 a process for the treatment of used rubber tires by vacuum pyrolysis in a reactor to produce liquid and gaseous hydrocarbons and a solid carbonaceous material. According to this process, the pyrolysis of the tires is carried out at a temperature in the range of about 360° C. to about 415° C., under a subatmospheric pressure of less than about 35 mm Hg and such that gases and vapors produced in the reactor have a residence time of the order of a few seconds. As a result, pyrolytic oils are obtained in substantially maximum yield. Typically, about 60 weight % hydrocarbon oils, about 38 weight % solid carbonaceous material and about 2 weight % gaseous hydrocarbons can be produced by such a process. As indicated in Applicant's aforementioned patent, the hydrocarbon oils produced have a calorific value of about 10,200 kcal $kg^{-1}$ and are thus suitable for use as heating fuel. However, it would be desirable to increase the value of these pyrolytic oils with a view to obtaining commercially valuable chemicals.

It is therefore an object of the present invention to extract commercially valuable chemicals from tire-derived pyrolytic oils.

According to one aspect of the invention, there is provided a method of extracting commercially valuable chemicals from tire-derived pyrolytic oils, which comprises subjecting the pyrolytic oils to a fractional distillation at a temperature of up to about 204° C. under atmospheric pressure to isolate at least one commercially valuable chemical selected from the group consisting of paraffins, naphthenes, olefins and aromatics.

Preferably, the method of the invention involves two fractional distillations and thus comprises the steps of:

a) subjecting the pyrolytic oils to a fractional distillation at a temperature of up to about 204° C. under atmospheric pressure;

b) recovering a fraction boiling in the range of about 43° C. to about 204° C.; and c) subjecting the fraction to a further fractional distillation to isolate at least one commercially valuable chemical selected from the group consisting of paraffins, naphthenes, olefins and aromatics.

Applicant has found quite unexpectedly that the distillation fraction boiling below 204° C. obtained by fractional distillation of tire-derived pyrolytic oils contains commercially valuable chemicals. The PONA analysis of such a fraction which constitutes about 27 weight % of the pyrolytic oils gave about 25 weight % paraffins, about 7 weight % naphthenes, about 43 weight % olefins and about 25 weight % atomatics. It has a calorific value of about 43,700 $Jg^{-1}$.

Particularly interesting compounds identified in the above distillation fraction are benzene (b.p. 80.1° C.), toluene (b.p. 110.6° C.), o-xylene (b.p. 144.4° C.), m-xylene (b.p. 139.1° C.), p-xylene (b.p. 138.3° C.) and styrene (b.p. 145.2° C.) These compounds can be used as solvents and petrochemical feedstock in the synthesis of various polymers. For example, styrene is mainly used in the production of plastics, rubber and resins. Xylene is particularly useful in the production of polyester fibers; it is also used as solvent and starting material in the production of benzoic and isophthalic acids. Toluene is also used for the production of benzoic acid.

Another compound of interest identified in the fraction boiling below 204° C. is limonene-dl (b.p. 178° C.) which constitutes the major component of the fraction. The presence of limonene-dl is totally unexpected since this compound is a terpene which is usually derived from essential oils such as lemon and orange oils. It is mainly used as a flavoring agent in the food and fragrance industries.

Thus, by carrying out the fractional distillation of the pyrolytic oils to recover a fraction boiling in the range of about 70° C. to about 204° C., it is possible to concentrate in such a fraction the above commercially valuable chemicals. This distillation fraction can typically contain about 3 weight % benzene, about 8 weight % toluene, about 7 weight % xylene, about 6 weight % styrene and about 17 weight % limonene-dl.

The present invention therefore provides, in another aspect thereof, a distillation fraction boiling in the range of about 43° C. to about 204° C., preferably from about 70° C. to about 204° C., under atmospheric pressure and obtained by fractional distillation of tire-derived pyrolytic oils.

According to a further aspect of the invention, there is also provided a method of extracting limonene-dl from a distillation fraction boiling in the range of about 43° C. to about 204° C., preferably from about 70° C. to about 204° C., under atmospheric pressure and obtained by fractional distillation of tire-derived pyrolytic oils, which comprises subjecting the fraction to a fractional distillation at a temperature of about 178° C. under atmospheric pressure to isolate limonene-dl.

The tire-derived pyrolytic oils used in accordance with the invention therefore constitute a source of commercially valuable chemicals and thus enable the vacuum pyrolysis of used rubber tires to become a commercially attractive solution to the problems created by the accumulation of large quantities of scrap tires.

The following non-limiting examples further illustrate the invention.

EXAMPLE 1

Used rubber tires in the form of cuttings were treated by vacuum pyrolysis in accordance with Example No. 5 of U.S. Pat. No. 4,740,270 to produce 61.2 weight % hydrocarbon oils, 36.6 weight % char and 2.2 weight % gases. These pyrolytic oils were then subjected to a fractional distillation by slowly heating the oils up to a temperature of about 204° C. under atmospheric pressure and recovering a fraction boiling in the range of about 43° C. to about 204° C.. This fraction which constituted about 26.8 weight % of the pyrolytic oils was subjected to a further fractional distillation to isolate the major components thereof. The results are reported in the following Table 1:

TABLE 1

| Components | Weight % (*) |
|---|---|
| Methylpentene | 1.44 |
| Dimethylpentane | 1.04 |
| Benzene | 2.54 |
| 2,4,4-Trimethyl-1-pentene | 1.43 |
| Dimethylcyclopentadiene | 1.58 |
| Toluene | 6.95 |
| Cyclopentanone | 1.00 |
| 4-Vinyl-1-cyclohexene | 1.66 |
| o-Xylene | 0.91 |
| m-Xylene | 2.43 |
| p-Xylene | 2.78 |
| Styrene | 5.44 |
| α-Methylstyrene | 1.23 |
| Limonene-dl | 14.92 |

(*) based on the total mass of the fraction.

As it is apparent from Table 1, the compounds of interest, namely benzene, toluene, xylene, styrene and limonene-dl, are present in the fraction boiling in the range of 43°-204° C., relatively important quantities.

EXAMPLE 2

The procedure of Example 1 was repeated, except that a fraction boiling in the range of about 70° C. to about 204° C. was recovered. This fraction was subjected to a further fractional distillation to isolate benzene, toluene, xylene, styrene and limonene-dl. The results are reported in the following Table 2:

TABLE 2

| Components | Weight % (*) |
|---|---|
| Benzene | 2.8 |
| Toluene | 7.7 |
| o-Xylene | 1.0 |
| m-Xylene | 2.7 |
| p-Xylene | 3.1 |
| Styrene | 6.1 |
| Limonene-dl | 16.6 |

(*) based on the total mass of the fraction.

As it is apparent from Table 2, by carrying out the fractional distillation of the pyrolytic oils to recover a fraction boiling in the range of 70°-204° C., it is possible to concentrate in such a fraction the above commercially valuable chemicals.

I claim:

1. A distillation fraction boiling in the range of about 43° C. to about 204° C. under atmospheric pressure and obtained by fractional distillation of tire-derived pyrolytic oils, said fraction comprising limonene-dl in an amount greater than the individual amounts of other compounds present in said fraction.

2. A distillation fraction as claimed in claim 1, containing about 25 weight % paraffins, about 7 weight % naphthenes, about 43 weight % olefins and about 25 weight % aromatics.

3. A distillation fraction as claimed in claim 1, boiling in the range of about 70° C. to about 204° C. under atmospheric pressure.

4. A distillation fraction as claimed in claim 3, containing about 3 weight % benzene, about 8 weight % toluene, about 7 weight % xylene, about 6 weight % styrene and about 17 weight % limonene-dl.

5. A distillation fraction as claimed in claim 1, having a calorific value of about 43,700 $Jg^{-1}$.

6. A distillation fraction as claimed in claim 1, wherein said pyrolytic oils are derived by vacuum pyrolysis of rubber tires.

* * * * *